US006058657A

United States Patent [19]

Merla

[11] Patent Number: 6,058,657

[45] Date of Patent: May 9, 2000

[54] PLASTIC MATERIAL PROFILE FOR REFRIGERATORS HAVING A RIGID DEFORMABLE BASE

[75] Inventor: Adriano Merla, Angera, Italy

[73] Assignee: Industrie Ilpea S.p.A., Malgesso, Italy

[21] Appl. No.: 09/105,205

[22] Filed: Jun. 26, 1998

[30] Foreign Application Priority Data

Sep. 30, 1997 [IT] Italy ..... MI97A2217

[51] Int. Cl.[7] ..... E06B 7/16

[52] U.S. Cl. ..... 49/478.1; 49/490.1; 49/493.1

[58] Field of Search ..... 49/475.1, 478.1, 49/490.1, 492.1, 493.1, 498.1

[56] References Cited

U.S. PATENT DOCUMENTS

| | | | |
|---|---|---|---|
| 4,700,509 | 10/1987 | Merla | 49/478.1 |
| 4,916,864 | 4/1990 | Thompson | 49/493.1 X |
| 5,606,828 | 3/1997 | Hall et al. | 49/490.1 |

FOREIGN PATENT DOCUMENTS

| | | |
|---|---|---|
| 0 319 087 A2 | 6/1989 | European Pat. Off. . |
| 35 25 540 A1 | 1/1987 | Germany . |
| 37 42 978 | 6/1989 | Germany . |
| 295 11 425 U 1 | 12/1995 | Germany . |
| 296 19 300 U 1 | 2/1997 | Germany . |
| 295 20 234 U 1 | 5/1997 | Germany . |

*Primary Examiner*—Jerry Redman
*Attorney, Agent, or Firm*—Oblon, Spivak, McClelland, Maier & Neustadt, P.C.

[57] ABSTRACT

A plastic material profile (1) for refrigerators and freezers include a door (30) and an inner door (31) having a bellows gasket (20) portion which provides a seal between the door and the cabinet (32). The profile and the gasket portion are coupled together, or they are just one integral part obtained by coextrusion of two materials having different stiffness in order to allow, when needed, an easy disjunction of the gasket portion from the profile along their connection area, said profile having a groove (23) suitable to receive, in substitution, a bellows gasket portion, said groove (23) being defined by a pair of walls (5) and (5') which extend vertically or obliquely from a base (3), characterized in that said base (3) is shaped substantially as a C-section which can be elastically deformed by means of a soft material elbow (8) obtained by coextrusion on the same section, such elbow thus working as a hinge to allow the elastic enlargement of said C-section, in order to realize the snap engagement of the edge of said inner door (31) inside (19) the section itself, and, externally and below said C-section, of the profile, providing a sealing on the edge of said door (30).

9 Claims, 5 Drawing Sheets

PLASTIC MATERIAL PROFILE FOR REFRIGERATORS HAVING A RIGID DEFORMABLE BASE

BACKGROUND OF THE INVENTION

In previous patents by the same Applicant, plastic material profiles for refrigerators and the like provided with a door and an inner door are disclosed having a bellows gasket portion which provides the sealing between the door and the cabinet, wherein the profile and the gasket portion are coupled together, or they are just one integral part obtained by coextrusion of two materials having different stiffness in order to allow, when needed, an easy disjunction of the gasket portion from the profile along their connection area, said profile having a groove suitable to receive, in substitution, a bellows gasket portion, and at least one elastically yielding side flange, which acts as a spring to realize a snap engagement of the profile and of the inner door. Examples of such a structure are described in Applicant's European patent No. 0.146.994 and European patent No. 0.319.087.

In the Applicant's Italian patent application No. 96A000046, a profile of the kind above is described, wherein said groove is defined by a pair of walls which extend vertically or obliquely from a base which in the engaged working position overlaps the door and the inner door along their engagement line. The profile section has, in its intermediate position, an irregular T shape because of a central rib which extends vertically in opposite direction to the one going towards the cabinet. Said elastically yielding side flange, working as an elastic spring, extends from such rib end.

A similar structure, with a T shaped section caused by a rib extending within the space defined by the door and the inner door, is described in European patent no. 0.319.087.

In European patent no. 0.164.994, the profile section is instead substantially U shaped which always extends in the space defined between the door and the inner door, lower than the base of the profile.

In these types of known profiles, the section which extends in the lower portion within the space defined between the door and the inner door can measure between 9 and 12 mm, which is a significant portion of space considering the total space thickness between the door and the inner door.

However, recently, the refrigerator manufacturers have introduced doors with bars or handle supports which do not allow the use of profiles with sections extending within the space under the plane comprising the door/inner door junction line.

SUMMARY OF THE INVENTION

A purpose of the present invention is to provide a profile having, a section that does not not present any overlap problem with the space defined between the door and the inner door.

According to the purposes of the present invention, said profile shall, however, substantially maintain all the basic advantages of the profiles known from the above prior art, and mainly to be able to assembly the door/inner door parts quickly, for instance through automated systems, and reliable, assuring a precise and stable junction of the parts during the handling of the parts themselves in the manufacturing phase. According to the invention purposes, it is further desirable to maintain sealing characteristics both thermal, i.e. the basic characteristic required by this kind of gasket, both for the filling operation of the door/inner door space which, as known, has to receive a thermally insulating material such as polyurethane foam, which is injected after the door and inner door assembly.

In order to achieve the purposes and other advantages which will be clearer in the following description, the invention discloses a plastic material profile for refrigerators and the like provided with a door and an inner door having a bellows gasket portion which provides the sealing between the door and the cabinet, wherein the profile and the gasket portion are coupled together, or they are just one integral part obtained by coextrusion of two materials having different stiffness in order to allow, when needed, an easy disjunction of the gasket portion from the profile along their connection area, the profile having a groove suitable to receive, in substitution, a bellows gasket portion. The groove is defined by a pair of walls which extend vertically or obliquely from a base, characterised in that the base is shaped substantially as a C section which can be elastically deformed by means of a soft material elbow obtained by coextrusion on the same section, such elbow working as a hinge to allow the elastic enlargement of said C section in order to realize a snap engagement of the edge of said inner door inside the section itself, and the profile in its working position realizing a sealing on said door edge externally and below said C section.

BRIEF DESCRIPTION OF THE DRAWINGS

In order to better understand the characteristics and the advantages of the above defined invention, examples of non limiting embodiments with reference to the attached figures drawings are provided below.

DETAILED DESCRIPTION OF THE PREFERRED EMBODIMENTS

Figure 1:
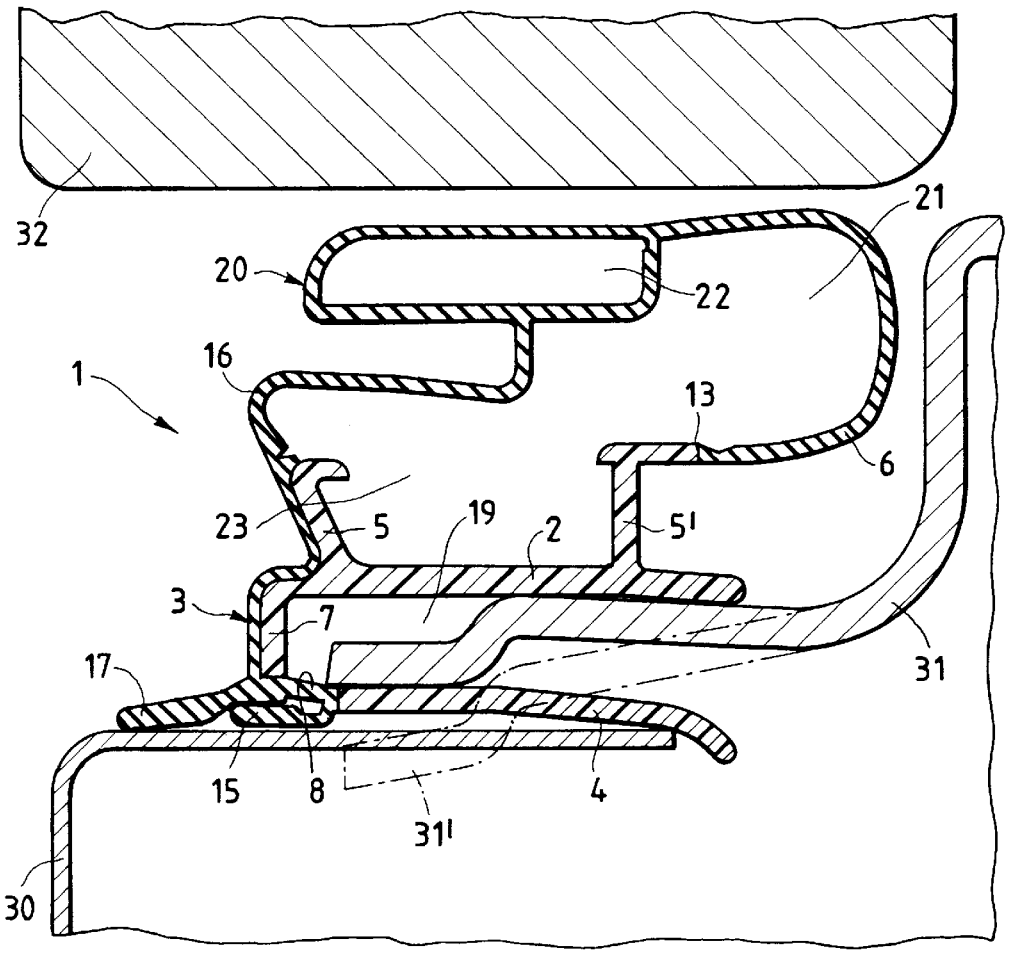
FIGS. 1, 2, 3 and 4 show profile sections according to different embodiment of the present invention.

Referring to FIG. 1, a plastic material profile 1 for refrigerators provided with a door 30 and inner door 31, having a bellows gasket portion 20 which provides the sealing between the door and the refrigerator cabinet 32. The profile and the gasket portion are coupled together, or they are just one integral part obtained by coextrusion of two materials having different stiffness in order to allow, when needed, an easy disjunction of the gasket portion from the profile along their connection area. Said rigid material profile defines a central groove 23 suitable to receive, in substitution, a bellows gasket portion, said groove 23 being defined by a pair of walls 5 and 5' which extends vertically or obliquely from a base indicated by numeral 3. According to the invention the base 3 is shaped substantially as a C section defined by two horizontal portions 2 and 4, upper and lower respectively, and a vertical portion 7. The vertical portion 7 and the lower horizontal portion 4 are joined together by a soft material elbow 8 obtained by coextrusion on the same section with the rigid material providing the profile base 3, such elbow 8 working as a hinge to allow the elastic enlargement of said C section, in particular of the lower horizontal portion 4 in relation to the portions 2 and 7. The profile 1 is made of rigid plastic material, for instance, PVC, forged by extrusion, cut and welded at the edges according to a frame shape that repeats the door perimeter of the refrigerator structure to be applied thereto. As already mentioned, also a gasket 20, for instance in plasticized soft PVC, is molded as a coextrusion single piece with the said profile 1.

The gasket 20 has a tubular section defining an expansible chamber 21 as a bellows wherefrom a seat 22, suitable to receive a magnetic metal bar, extends. The inner lateral wall 6 of gasket 20 is welded to the corresponding profile wall 5' at the coextrusion point 13, while the outer lateral wall 16 is integrally welded to the corresponding outer wall 5 of the profile and along the outer side of base 3. In the drawing examples, the lower configuration of the outer lateral wall 16 of the gasket (said wall can be advantageously divided in two parts with different thickness or stiffness in order to obtain lateral stability) completely covers the profile, ending, in the lower part, with the same elbow 8 defined above. As shown in the drawings, a pair of sealing straps 15 and 17, made of the same soft material, extend laterally from the elbow outwardly towards the profile, said straps resting on the door 30 when the parts are assembled in working position, so as to cover completely the rigid part of the profile 1 in the position.

Figure 2:
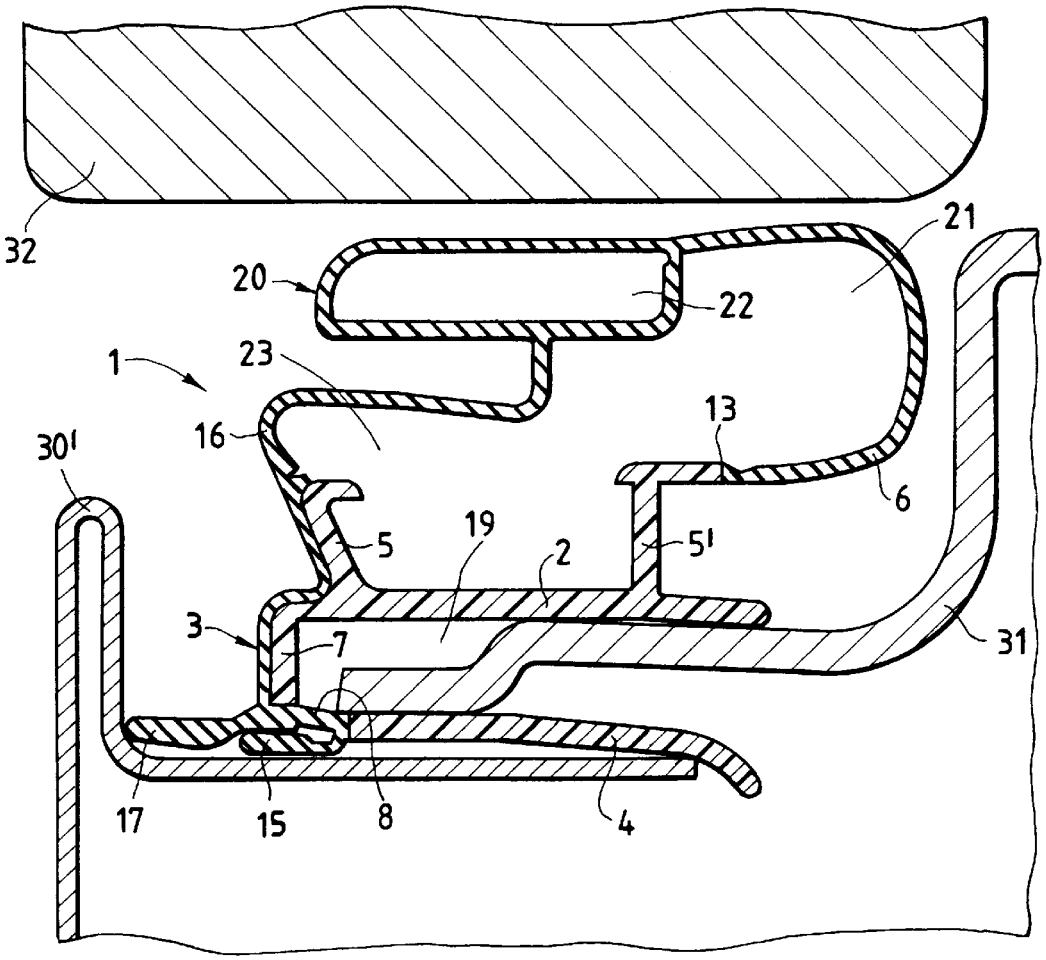
Figure 3:
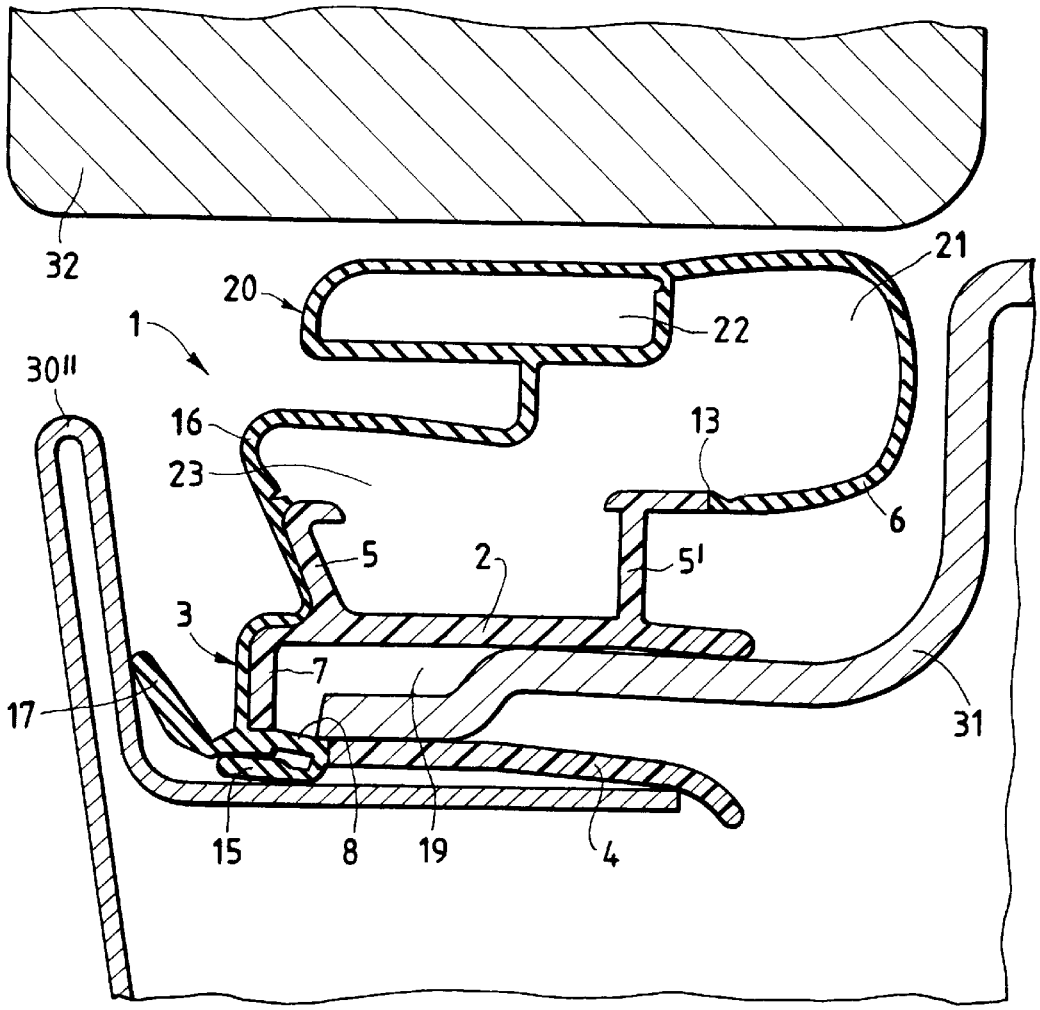

Even in relation to another advantage of the invention, in FIGS. 2 and 3 the door 30 is shown according to different embodiments, consisting in a shoulder 30' (FIG. 2) or 30" (FIG. 3) extending towards the cabinet, in respect of the different flat embodiment without any shoulder shown in FIG. 1, in order to cover the entire profile in the closing position shown in FIGS. 2 and 3.

In particular, the sealing strap 15 constitutes a containment gasket of the foaming operation which is performed at the end to give thermoinsulating properties to the door after assembly of the parts. The strap 17 makes a seal contact with the door plate independently from its configuration, since it is able to make a seal contact with it both in case of the flat configuration of FIG. 1 or in case of the shoulder configuration, even inclined as in FIG. 3.

For the practical working, the profile 1 supporting the coextruded gasket 20 is advantageously prepared in a rectangular frame shape welded at the corners, and under said shape it is provided to the refrigerator manufacturers, as is described in the above mentioned European patents of the Applicant.

The gasket is welded to form a rectangular frame and it can, then, be assembled on an inner door of the same shape, generally with the perimeter dimensions 0,5–3 mm smaller than the inner dimension defined by the vertical portion 7 of the base 3. This assembly is possible due to a 3–5 mm deep cut along the entire length of the horizontal portion 4 performed automatically during extrusion (or at the ends of the already cut portions), which allows the welding in the corners along said portion to be avoided.

Figure 5:
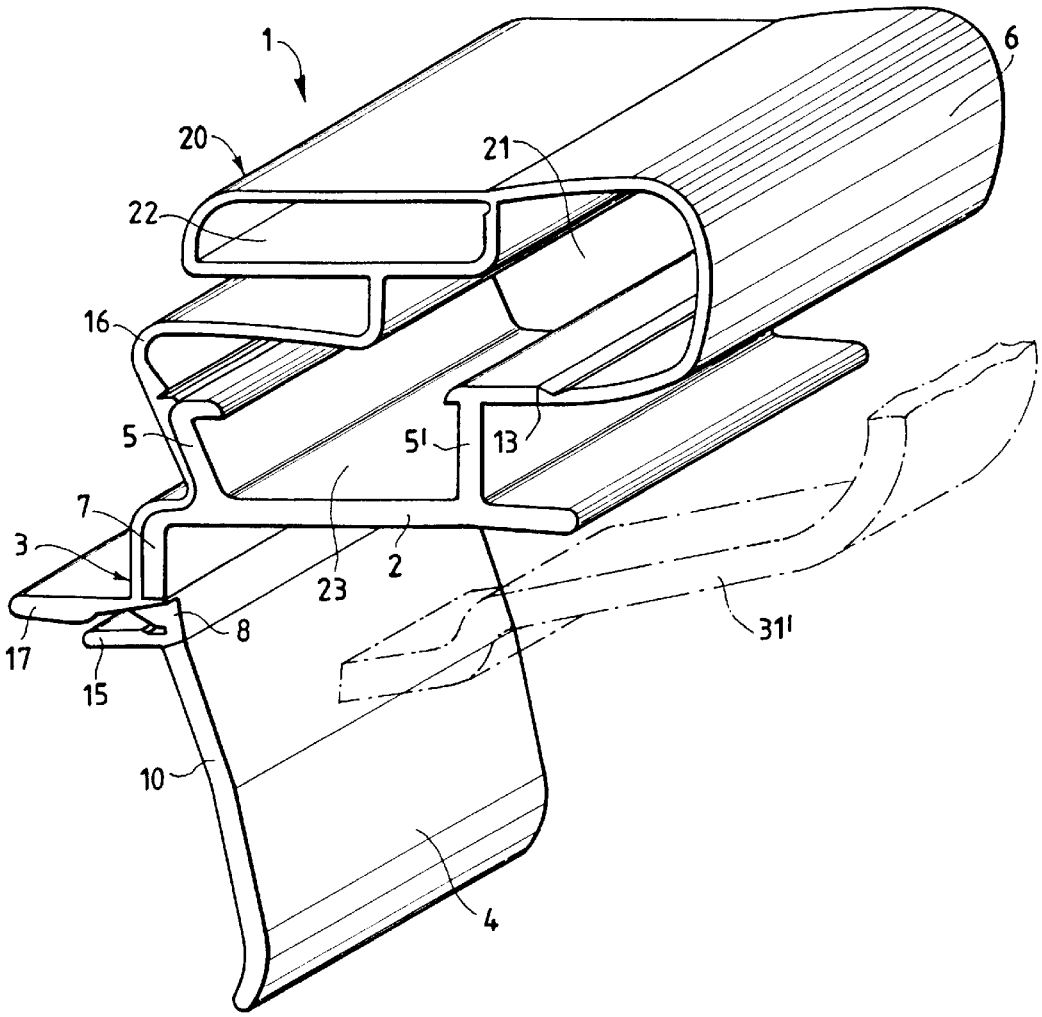
FIG. 5 shows a perspective view of the invention profile cut in a portion suitable to be welded to an identical portion to form a frame.

Then, each portion 4 is not welded and is therefore independently and easily enlargeble downwards, about the hinge point 8, at angles even over 90° in order to allow the introduction of the inner door 31 as shown in FIG. 5.

In FIG. 5, it is shown that the profile along the welding area with another profile portion is suitable to be welded everywhere except for portion 4 preventively cut along 10. The edge of the inner door 31 can be advantageously elastically preloaded, according to the position shown by the dotted line 31' in FIGS. 1 and 5.

The enlargement of portion 4 can be obtained manually or by means of a machine provided with an automatic device which displaces the lower portion 4 of all four sides of the frame by an angle sufficient to position the inner door as shown in FIG. 5. Once this operation has been performed, the portions 4 are delivered and the hinge 8 brings them snap-back in the initial position of FIG. 1, blocking the inner door between portion 4 and portion 2 of the profile base.

In such position, shown by a full line in FIG. 1, the lower portions 4 of the profile are elastically biased against the preloaded edge of the inner door 31.

According to FIGS. 1, 2 and 3, the profile 1 and the inner door 31 so assembled are then put on the door 30 (for example, by means of a robot system) and the assembly is blocked by the foaming of the cavity between the door and the inner door. In this working final position, the profile makes a sealing contact on the edge of the door 30 corresponding to sealing straps 15 and 17, therefore below and externally to said C section.

The profile, once introduced in the inner door, becomes integral with said inner door and they can be moved in a rough way without causing any disjunction.

This fact is very important when the two assembled parts are positioned on the foaming dies, because it is possible to work quickly, precisely and safely.

The walls 5 and 5' of the profile allow the engagement of a spare gasket. Further, during the foaming operation they allow a limited deformation of the profile and therefore a very limited deformation of the soft portion, as already described above.

The soft material coextruded externally to the profile avoids the possible color differences between the rigid and the soft materials.

The substantially rigid structure of the profile avoids the partial breakdown of the profile itself over the horizontal sides because of the weight of the magnetic insert.

Figure 4:
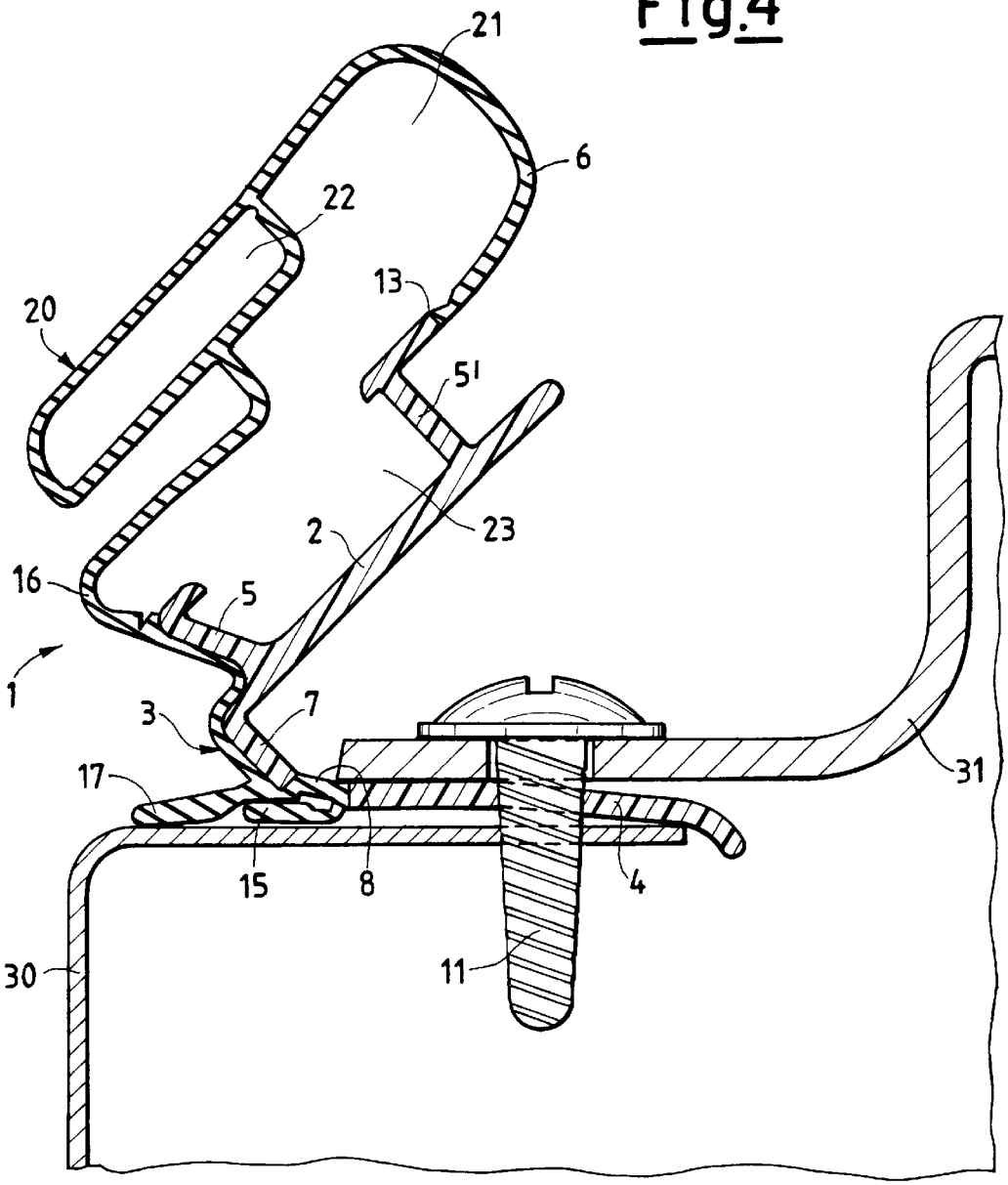

In the embodiment of FIG. 4, the profile is attached to door 30 without the integral foaming by means of self-threading screws 11 which block the rigid portion 4 (previously drilled) on the flat sheet of door 30.

The screws fixing can be performed because, said portion 4 of the base 3 being cut at the side ends, the profile, side by side, can be rotated upwards, by means of the hinge 8 made of soft material, therefore allowing the enlargement of the profile base as above described above. The Italian priority application no. MI97A 002217 is herein incorporated by reference.

I claim:

1. A gasket, comprising:

a bellows gasket portion configured to seal an outer door and a cabinet;

a base substantially shaped as a C-section;

an outer wall extending from the base;

an inner wall extending from the base, said outer wall, said inner wall, and said base defining a groove configured to receive the bellows gasket portion;

said base including an elastically deformable elbow forming a hinge that allows elastic enlargement of said C-section to permit snap engagement of an edge of an inner door inside the C-section, and a first strip extending from the deformable elbow thus providing a sealing on the edge of the outer door externally and below said C-section.

2. A gasket according to claim 1, further comprising:

a second sealing strap, said first and second sealing straps are formed of a soft material extending from said elbow and toward the outer door to provide a seal on said outer door.

3. A gasket according to claim 1, wherein said bellows gasket portion is coextruded with the rest of said gasket so that an outer portion of said bellows gasket portion overlaps the outer wall and an outer portion of said base.

4. A gasket according to claim 3, wherein said elbow is integrally formed with the outer portion of said bellows gasket portion that overlaps the outer wall and the outer portion of said base.

5. A gasket according to claim 1, wherein the base comprises:

an upper horizontal portion;

a lower horizontal portion; and a vertical portion, said lower horizontal portion being cut along a line near a welding area with another gasket.

6. A gasket according to claim 1, wherein the bellows gasket portion is coupled to the rest of the gasket.

7. A gasket according to claim 1, wherein the bellows gasket portion is formed integrally with the rest of the gasket by coextruding two materials having a different stiffness to permit easy separation of the bellows gasket portion from the rest of the gasket along a connection area between the bellows gasket portion and the rest of the gasket.

8. A gasket according to claim 1, wherein both the outer wall and the inner wall extend perpendicularly from the base.

9. A gasket according to claim 1, wherein both the outer wall and the inner wall extend obliquely from the base.

* * * * *

UNITED STATES PATENT AND TRADEMARK OFFICE

CERTIFICATE OF CORRECTION

PATENT NO. : 6,058,657

DATED : May 9, 2000

INVENTOR(S): Andriano MERLA

It is certified that an error appears in the above-identified patent and that said Letters Patent is hereby corrected as shown below:

On the Title page, the CPA information has been omitted. It should read as follows:

--- [45] **Date of Patent: *May 9, 2000** ---

--- [ * ] Notice: This patent issued on a continued prosecution application filed under 37 CFR 1.53(d), and is subject to the twenty year patent term provisions of 35 U.S.C. 154(a)(2). ---

Signed and Sealed this

Seventeenth Day of April, 2001

*Attest:*

Nicholas P. Godici

NICHOLAS P. GODICI

*Attesting Officer*

*Acting Director of the United States Patent and Trademark Office*